United States Patent [19]

Grilliot et al.

[11] Patent Number: 4,879,769

[45] Date of Patent: Nov. 14, 1989

[54] FIREFIGHTER'S BOOT AND TROUSER ATTACHMENT

[76] Inventors: William L. Grilliot; Mary I. Grilliot, both of 1986 Home Ave., Dayton, Ohio 45417

[21] Appl. No.: 215,300

[22] Filed: Jul. 5, 1988

[51] Int. Cl.[4] ..... A41F 9/00

[52] U.S. Cl. ..... 2/312; 2/DIG. 6

[58] Field of Search ..... 2/312, 300, 242, 232, 2/232 A, DIG. 6

[56] References Cited

U.S. PATENT DOCUMENTS

| | | | |
|---|---|---|---|
| 2,525,756 | 10/1950 | Aines | 2/232 |
| 2,596,112 | 5/1952 | Aines | 2/232 |
| 4,498,201 | 2/1985 | Carter | 2/312 |

*Primary Examiner*—Ronald Feldbaum

*Attorney, Agent, or Firm*—Jacox & Meckstroth

[57] ABSTRACT

An attachment device for attaching a firefighter's trousers to the firefighter's boots, in which the trousers cover a portion of the firefighter's boots. The attachment device maintains the firefighter's trousers in covering relationship to the boots, and portions of the trousers cannot become lodged on the upper edge of the boots as the firefighter bends and crawls and the like. Each attachment device has a band which encompasses one of the firefighter's boots. A strap extends from the band and has fastener elements which attach to portions of the firefighter's trousers which encompass the boot. Thus, the trousers are attached to the boot.

10 Claims, 1 Drawing Sheet

FIREFIGHTER'S BOOT AND TROUSER ATTACHMENT

BACKGROUND OF THE INVENTION

A firefighter normally wears boots. A firefighter also normally wears trousers which cover a portion of the boots. The trousers conventionally have a plurality of protective layers.

During firefighting activities a firefighter frequently finds it necessary to bend over, to crawl, and to assume various strenuous body positions. When these movements and positions occur, a portion of the trousers or one of the layers of the trousers may be drawn upwardly with respect to the boots and caught at the upper edge of one or both of the boots. When this occurs, the protection provided to the lower portion of the firefighter's leg is reduced. After the firefighter assumes an upright position, it is necessary for the firefighter to dislodge the portion of the trousers which has become lodged on the upper edge of the boot. Such dislodging requires additional time and energy of a firefighter who is busily engaged in fighting a fire.

It is therefore an object of this invention to provide attachment means by which a firefighter's boots and trousers are attached together in a manner to prevent any portion of the trousers from becoming lodged at the upper edge of the firefighter's boots.

It is another object of this invention to provide such attachment means which can be easily and readily attached to the firefighter's boots and trousers.

It is another object of this invention to provide such attachment means which, if desired, can be permanently secured to a firefighter's boots or trousers.

It is another object of this invention to provide such attachment means which includes adjustment means to accommodate boots and trousers which have various dimensions.

Other objects and advantages of this invention reside in the construction of parts, the combination thereof, the method of production and the mode of use, as will become more apparent from the following description.

SUMMARY OF THE INVENTION

An attachment device of this invention comprises a band which encompasses a portion of a firefighter's boot. One or more straps are attached to the band and extend from the band. The straps and the trousers are provided with fastener means for fastening the strap to the trousers. Thus, the trousers are secured to the boot, and the lower portions of the trousers are maintained adjacent the lower part of the boot, and no portion of the trousers can become lodged at the upper edge of the boot.

DETAILED DESCRIPTION OF THE INVENTION

Figure 1:
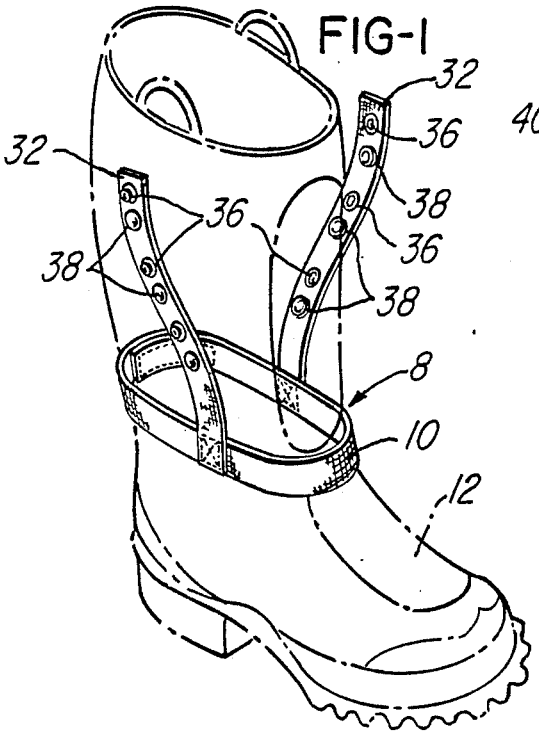
FIG. 1 is a front perspective view, illustrating the attachment device of this invention attached to a firefighter's boot.

An attachment device 8 of this invention comprises an elongate band 10, which is adapted to wrap around a firefighter's boot 12 as best illustrated in FIG. 1. The elongate band 10 is provided with means at each end thereof for attaching the two ends together for attaching the band 10 to the boot 12. Herein the band 10 is shown as having hook and pile elements at the ends thereof for attachment of the ends together. Herein a hook or pile element 18 is secured to one end of the band 10, and a hook or pile element 20 is secured to the other end of the band 10.

Extending at an angle from the band 10 is a plurality of strips or straps 32. The strips or straps 32 are attached to the band 10 by any suitable means, such as by stitching, or by any other attachment method. The straps 32 are adapted to be positioned on opposite sides of the firefighter's boot. Each of the straps 32 carries a plurality of fastener elements 36 and a plurality of fastener elements 38. Each of the fastener elements 36 has a protuberance, and each of the fastener elements 38 has a complementary recess which is adapted to resiliently receive a protuberance of a fastener element 36. The fastener elements 36 and 38 are alternately arranged along the length of the straps 32.

Figure 2:
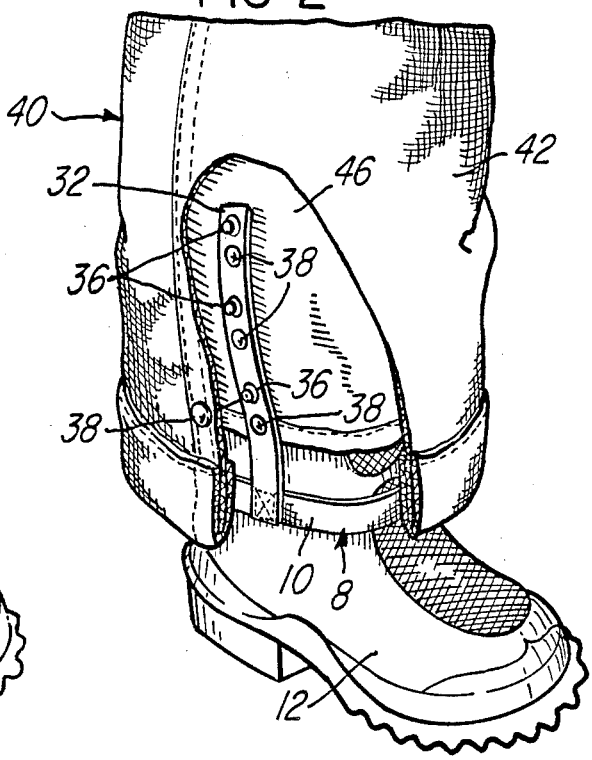
FIG. 2 is a front perspective view, drawn on substantially the same scale as FIG. 1, with parts broken away and shown in section, and showing the attachment device of this invention attached to a firefighter's boot, and illustrating the manner in which the attachment device is attached to trousers of a firefighter.

The band 10 of the attachment device 8 is placed around a lower portion of the boot 12 and the hook and pile elements 18 and 20 are attached together so that the band 10 fits tightly around the boot 12, as shown in FIGS. 1 and 2.

Figure 3:
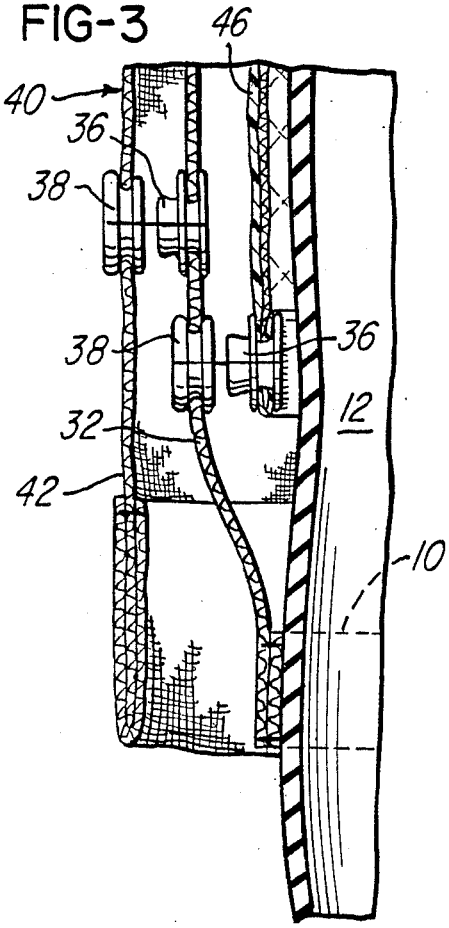
FIG. 3 is a greatly enlarged sectional view, showing an attachment device of this invention attached to a firefighter's boot and showing fastener elements attached to layers of the trousers of a firefighter, and illustrating attachment of the attachment device to the firefighter's trousers.
Figure 4:
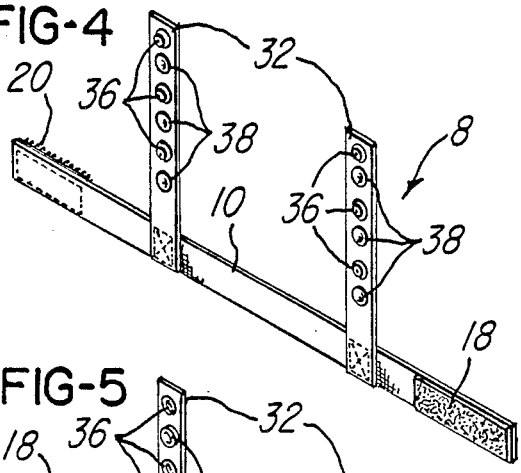
FIG. 4 is a perspective view, drawn on a slightly larger scale than FIGS. 1 and 2, and showing an attachment device of this invention in a "laid-out" condition, and showing one surface of the attachment device of this invention.
Figure 5:
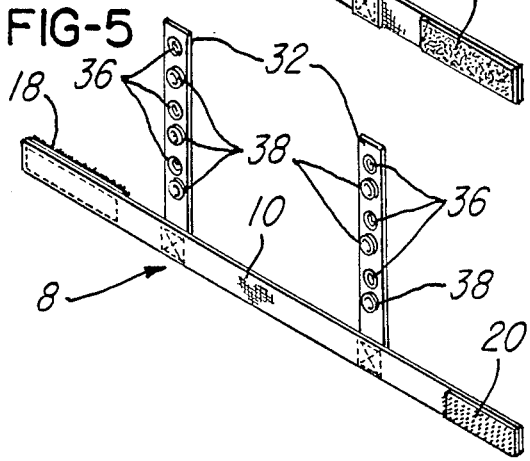
FIG. 5 is a perspective view, similar to FIG. 4, and drawn on substantially the same scale as FIG. 4, and showing the reverse surface of the attachment device of FIG. 4.

Trousers 40 encompass a major portion of the boot 12. The trousers 40 have an outer layer 42 and an inner layer 46. A fastener element 38 is shown attached to the outer layer 42 of the trousers 40, as illustrated in FIG. 3. A fastener element 36 is shown attached to the inner layer 46 of the trousers 40. A fastener element 36 which is carried by the strap 32 is attached to the fastener element 38 which is carried by the outer layer 42 of the trousers 40. A fastener element 38 which is carried by the strap 32 is attached to a fastener element 36 which is carried by the inner layer 46, as illustrated in FIG. 3.

Thus, the inner layer 46 and the outer layer 42 are secured to the boot 12 by means of the band 10 and by means of the straps 32 and the fastener elements 36 and 38. Thus, the portions of the trousers 40 to which the fastener elements 36 and 38 are secured are maintained adjacent the boot 12. Therefore, a portion of the trousers 40 cannot become lodged at the upper edge of the boot 12.

The fastener elements 36 and 38 are readily secured to the outer layer 42 and the inner layer 46 of the trousers 40. An attachment device 8 of this invention is easily attached to a boot 12, as the band 10 is placed in encompassing relationship to the boot 12 and the hook and pile elements 18 and 20 are attached together. Due to the fact that the band 10 is adjustable in circumference, the attachment device 8 is adapted to be attached to a boot 12 of any size and dimension. The fastener elements 36 and 38 which are carried by the straps 32 are readily attached to the fastener elements 36 and 38 which are carried by the inner layer 46 and the outer layer 42.

Due to the fact that the straps 32 have a series of fastener elements 36 and 38 carried thereby, the fastener elements 36 and 38 which are carried by the straps 32 can be attached to an adjacent fastener element 36 or 38 which is carried by the inner layer 46 and the outer layer 42.

The attachment device 8 of this invention is constructed of flame resistant and moisture resistant material. If desired, the attachment device 8 or portions thereof may be constructed of elastic type material.

Although the preferred embodiment of the firefighter's firefighter's boot and trouser attachment of this invention has been described, it will be understood that within the purview of this invention various changes may be made in the form, details, proportion and arrangement of parts, the combination thereof, the method of construction and the method of use, which generally stated consist in an attachment device and method within the scope of the appended claims.

The invention having been described, the following is claimed.

1. For use with a firefighter's boots and firefighter's trousers, as the firefighter's trousers normally cover a significant part of the firefighter's boots, an attachment device comprising a band which is adapted to encompass a firefighter's boot, strap means connected to the band and extending from the band, fastener means carried by the strap means, complementary fastener means carried by the firefighter's trousers and releasably attachable to the fastener means carried by the strap means, the attachment device thus attaching the firefighter's trousers, to the firefighter's boot.

2. The attachment device of claim 1 in which the strap means extends angularly from the band.

3. The attachment device of claim 1 in which the firefighter's trousers have an outer layer and an inner layer, the complementary fastener means being carried by the outer layer and by the inner layer, the outer layer and the inner layer of the firefighter's trousers thus being attached to the strap means and to the firefighter's boot.

4. The attachment device of claim 1 in which the band comprises a flexible elongate strip which is provided with a pair of spaced-apart connection elements, and in which the connection elements are releasably attached together as the strip encompasses the boot.

5. An attachment device for use by a firefighter who wears firefighter's boots and firefighter's trousers comprising first connection means, the first connection means including means adapted to encompass a portion of each of the firefighter's boots and attachable to the firefighter's boots, intermediate connection means extending from the first connection means, first fastener means, the first fastener means being carried by the intermediate connection means, second fastener means, the second fastener means being carried by the firefighter's trousers, the first and second fastener means being attachable together, whereby the firefighter's trousers are attached to the firefighter's boots.

6. An attachment device for use by a firefighter who wears firefighter's boots and firefighter's trousers and for attaching the firefighter's trousers to each of the firefighter's boots, as the trousers cover a significant portion of the boots comprising band means adapted to encompass a portion of the firefighter's boot, strap means attached to the band means and extending therefrom, a fastener element adapted to be carried by the trousers, and a fastener element carried by the strap means and releasably attachable to the fastener element which is carried by the trousers, the attachment device thus attaching the firefighter's trousers to the firefighter's boot.

7. The attachment device of claim 6 in which the firefighter's trousers have an outer layer and an inner layer, and which includes a fastener element carried by the outer layer and a fastener element carried by the inner layer, a fastener element carried by the strap means and releasably attachable to the fastener element which is carried by the outer layer, and a fastener element carried by the strap means and releasably attachable to the fastener element which is carried by the inner layer, the inner layer and the outer layer of the trousers thus being attached to the boot.

8. The attachment device of claim 6 in which the band means comprises an elongate strip provided with a pair of end portions, releasable connection means carried by each of the end portions, the releasable connection means which are at the end portions of the strip being attached together to tightly encompass the firefighter's boot.

9. The attachment device of claim 6 in which the band means comprises a strip which is adapted to tightly encompass the boot, and the strap means includes a plurality of straps which extend from the strip.

10. The attachment device of claim 6 in which the band means comprises a strip which is adapted to tightly encompass the boot, and the strap means includes a plurality of straps which extend angularly from the strip, and a plurality of fastener elements carried by each of the straps.

* * * * *